US005489023A

United States Patent [19]

Havlovitz

[11] Patent Number: 5,489,023

[45] Date of Patent: Feb. 6, 1996

[54] SHIPPING AND DISPENSING CARTON FOR STACKED COLLAPSIBLE SPREADERS

[75] Inventor: Paul M. Havlovitz, Escondido, Calif.

[73] Assignee: Republic Tool & Mfg. Corp., Carlsbad, Calif.

[21] Appl. No.: 357,916

[22] Filed: Dec. 16, 1994

[51] Int. Cl.[6] ..... B65D 85/62; B65D 21/02; A01C 17/00

[52] U.S. Cl. ..... 206/499; 206/45.31; 206/335; 206/576; 229/23 BT; 239/663; 239/687

[58] Field of Search ..... 206/499, 335, 206/821, 45.31, 44 R, 526; 239/666, 663, 682, 687; 229/23 BT; 222/143, 614

[56] References Cited

U.S. PATENT DOCUMENTS

| | | | |
|---|---|---|---|
| 2,185,328 | 1/1940 | Buttermann . | |
| 2,761,610 | 9/1956 | Welshenbach | 229/23 BT |
| 3,280,968 | 10/1966 | Craine . | |
| 3,343,659 | 9/1967 | Marondel | 206/45.31 |
| 3,580,472 | 5/1971 | Stawski | 206/499 X |
| 4,363,405 | 12/1982 | Christie . | |
| 4,511,090 | 4/1985 | Morgan | 239/666 |
| 4,580,730 | 4/1986 | Amerine | 239/687 |
| 4,991,716 | 2/1991 | Havlovitz | 206/335 |
| 5,016,753 | 5/1991 | Henderson | 229/23 BT X |
| 5,195,677 | 3/1993 | Quintana et al. . | |
| 5,203,510 | 4/1993 | Courtney et al. | 239/682 X |
| 5,348,147 | 9/1994 | Gottfreid | 206/499 X |
| 5,413,224 | 5/1995 | Marron et al. | 206/335 X |

*Primary Examiner*—Bryon P. Gehman
*Attorney, Agent, or Firm*—Harry Williams

[57] ABSTRACT

According to one embodiment of the present invention there is provided a two-part shipping and display carton for use with a stacked array of portable wheeled spreaders, each spreader having a hopper, a pair of wheels disposed below the hopper, a lower frame supporting the hopper, and an upper frame pivoted to the lower frame and being pivoted into a collapsed state so that the upper frame lies generally adjacent the lower frame. A bottom portion of the carton receives the stacked array of spreaders, while a top portion of the carton having a similar cross-sectional shape as the bottom portion and a height that is slightly higher than the height of the stacked array of spreaders fits within the bottom portion so that the outside surfaces of its walls contact the inside surfaces of the walls of the bottom portion when the top portion is lowered into the bottom portion. When the top portion is removed from the bottom portion the stacked array of spreaders supported in the bottom portion is on display and can be removed from the stacked array one-by-one.

8 Claims, 3 Drawing Sheets

FIG. 3
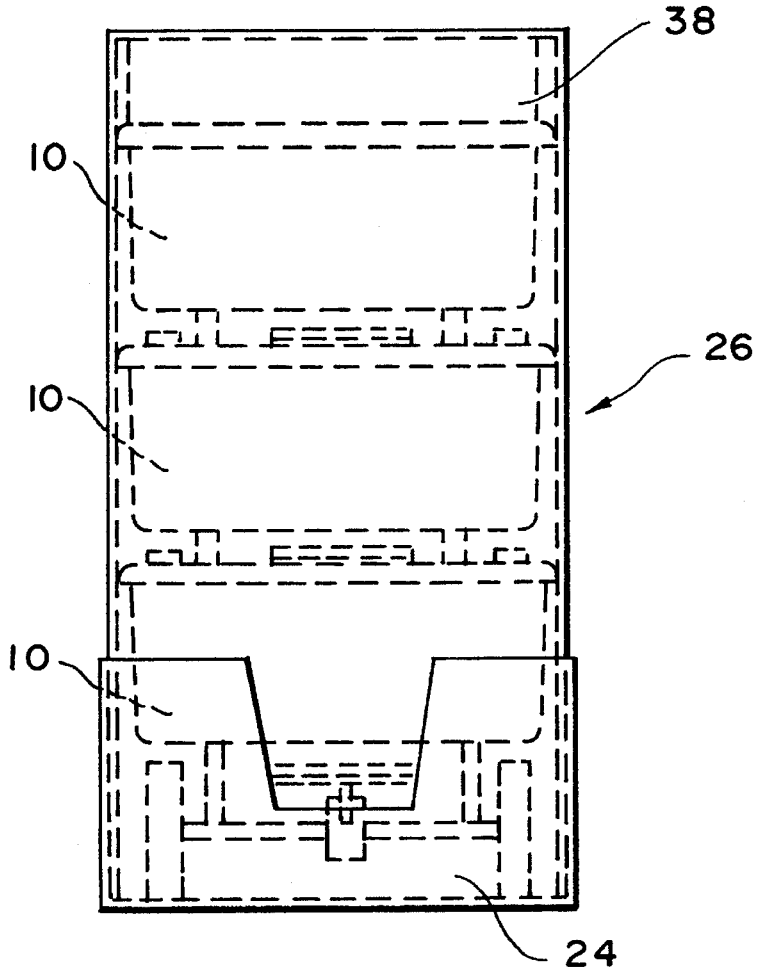
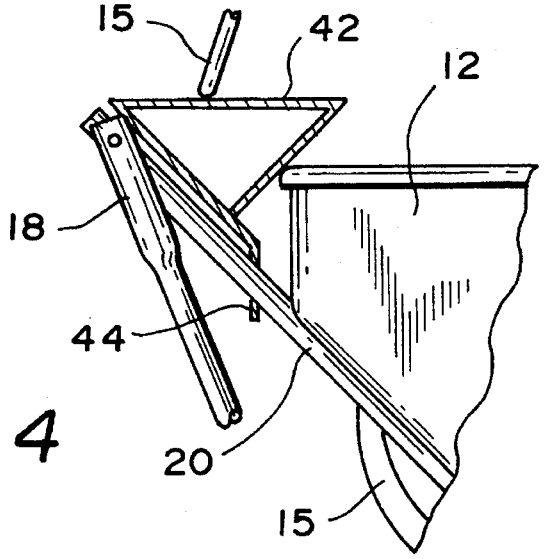
FIG. 4

SHIPPING AND DISPENSING CARTON FOR STACKED COLLAPSIBLE SPREADERS

BACKGROUND OF THE INVENTION

This invention relates to packaging materials for lawn and garden implements, particularly self-supporting collapsible spreaders.

Garden care implements such as wheeled spreaders and the like are normally packaged individually in one-item cartons at the factory and shipped from there to a sales terminus or retail outlet where usually one or two items are removed from their separate cartons and displayed for sale. When an item is purchased the purchaser is usually given a new packaged item from a storage area within the store.

There is a need then for relatively large lawn and garden items, such as a plurality of portable wheeled spreaders to be packaged in a stacked arrangement within a single carton for both shipping and display purposes, so that a prospective purchaser can see the item he or she wish to purchase while at the same time purchase the actual item being inspected.

OBJECTS AND SUMMARY OF THE INVENTION

It is a primary purpose and principle object of the present invention to address the aforementioned needs and provide a a single carton for packaging a plurality of portable wheeled spreaders that can be shipped from the factory and used as well for display purposes on the sales floor.

A feature of the present invention is the provision of a shipping and dispensing carton for a stacked array of portable wheeled spreaders in which a portion of the carton can be removed once the carton has arrived on the sales floor, leaving the stacked array of portable wheeled spreaders visible to the shopper, including whatever indicia and logos are arranged on the spreader hopper.

Still another feature of the present invention is to provide a single shipping and display carton for a stacked array of portable wheeled spreaders that can be manipulated by a single worker.

According to one embodiment of the present invention there is provided a two-part shipping and display carton for use with a stacked array of portable wheeled spreaders, each spreader having a hopper, a pair of wheels disposed below the hopper, a lower frame supporting the hopper, and an upper frame pivoted to the lower frame and being pivoted into a collapsed state so that the upper frame lies generally adjacent the lower frame. A bottom portion of the carton receives the stacked array of spreaders, while a top portion of the carton having a similar cross-sectional shape as the bottom portion and a height that is slightly higher than the height of the stacked array of spreaders fits within the bottom portion so that the outside surfaces of its walls contact the inside surfaces of the walls of the bottom portion when the top portion is lowered into the bottom portion. When the top portion is removed from the bottom portion the stacked array of spreaders supported in the bottom portion is on display and can be removed from the stacked array one-by-one.

The invention will be better understood as well as further objects and advantages thereof become more apparent from the ensuing detailed description taken in conjunction with the drawings.

BRIEF DESCRIPTION OF THE DRAWINGS

FIG. 3 is a schematic front elevational view of the carton according to the invention in which the top and bottom are shown about to be fitted one within the other; and FIG. 4 is a schematic partial cross-section of one of the spreaders shown in FIG. 1 fitted with an insert for enhancing the stacking of the spreaders.

DETAILED DESCRIPTION OF THE PREFERRED EMBODIMENT

Figure 1:
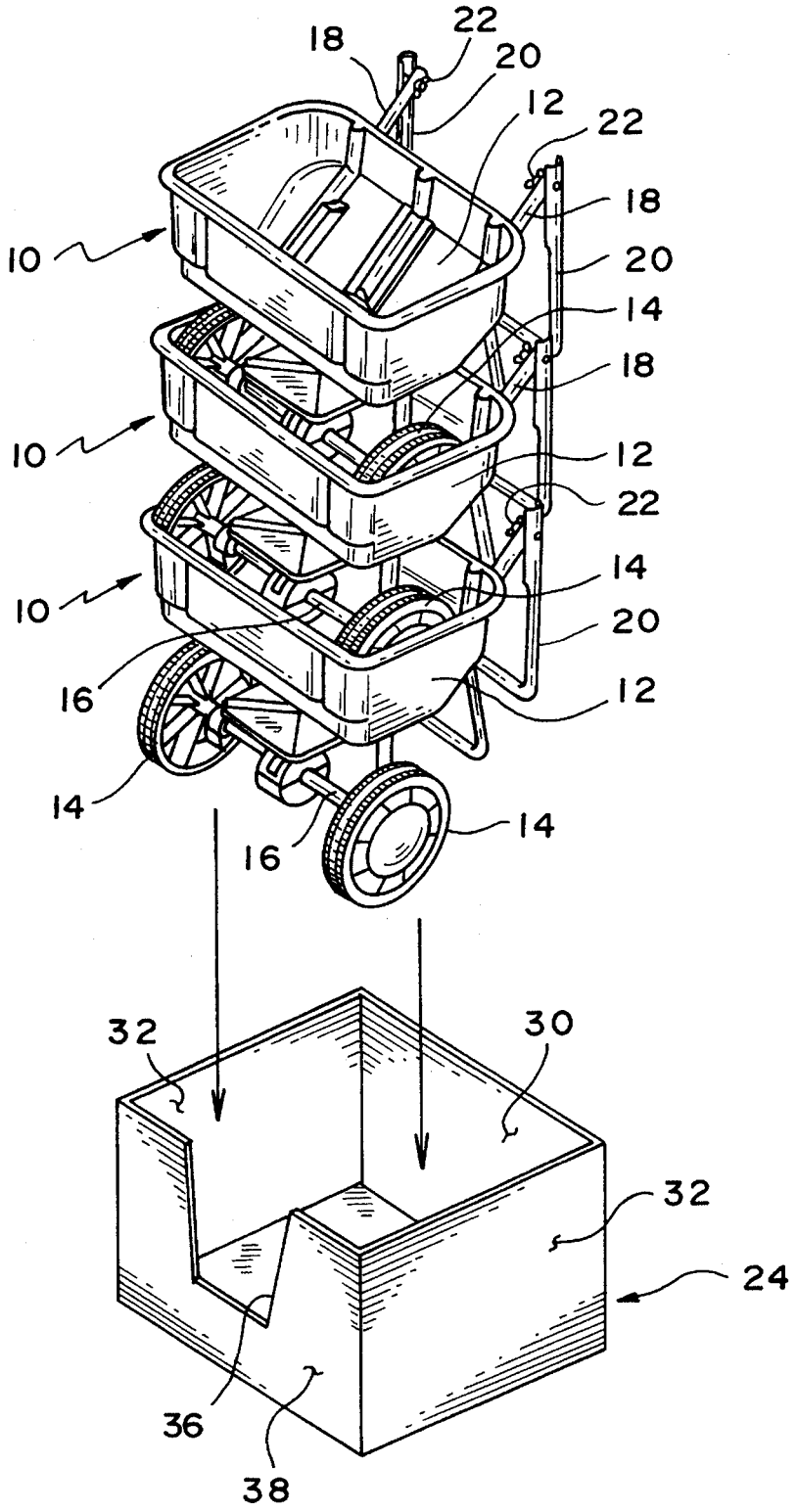
FIG. 1 is a schematic perspective view of a stacked array of portable wheeled spreaders arranged to fit in the lower portion a carton according to the invention.

Referring to FIG. 1 there is shown a stacked array of portable wheeled spreaders, according to the invention. Each spreader is of the same design described in my copending application, Ser. No. 08/357,917, filed on the same date as the present application, the disclosure of which is incorporated herewith by reference. It will be seen from FIG. 1 that each spreader 10 comprises a hopper 12 a pair of wheels 14 connected by an axle 16 and further that each spreader carries a lower and upper frame 18, 20 respectively which are pivotally connected by means of fasteners 22. An upright support frame 15 is shown extending from the underside of the hopper 12. As shown, each of the spreaders 10 are in the collapsed or storage state because the upper frame 20 is swung down into its collapsed position with respect to the rest of the spreader.

In this collapsed state the spreaders 10 can be nested one with the other, so that the wheels of one spreader rest inside the hopper of the underlying spreader and thus make for an economically spaced stacked array. The upper frame 20 is shown suspended by the lower frame so that it lies generally adjacent the lower frame and its associated hopper and extends in an overlapping manner beyond the articulated or pivoted portion of the lower and upper frames of the underlying spreader. Three stacked spreaders are shown, but it is within the scope of the present invention to have more, such as four or even five stacked spreaders, although it has been found that three or four spreaders can be accommodated in a carton that can be handled by a single worker.

The stacked array of spreaders is then fitted into the bottom 24 of a carton 26 (see FIG. 3). The bottom portion 24 of the carton 26 is designed to enhance the sales display of the contained spreaders, thus a back wall 30 faces the back of the stacked spreaders; sidewalls 32 slope downwardly towards the front and allow the eye to encompass the front portion of the spreaders, specifically the hopper portions; and the cut-out 36 in the front wall 38 allows the eye to read whatever logo is arranged on the front wall of the bottommost hopper. Of course the logos on the uppermost spreaders will be visible as well, owing to the low sidewalls of the carton 24 with respect to the significantly higher array of stacked spreaders, three or four, for example.

Figure 2:
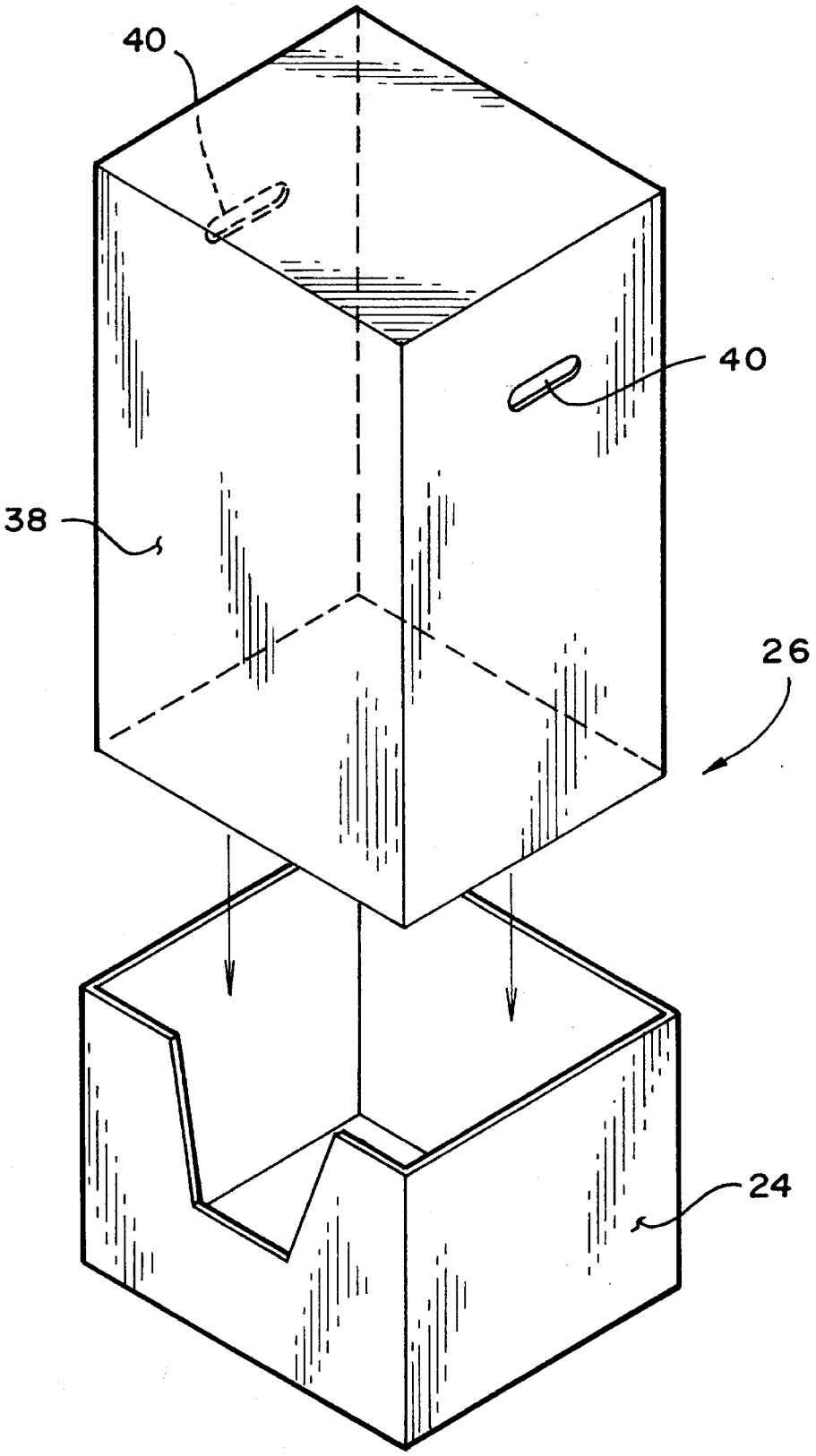
FIG. 2 is a schematic perspective of the complete carton according to the invention without the stacked array of portable wheeled spreaders positioned therein; and device according to the invention.

FIG. 2 shows the complete carton 26 with its lower bottom portion 24 and an upper top portion 38. In this view the stacked array of spreaders that would normally occupy the bottom portion 24 are not shown. It is important to stress here that the top portion when in place provides a shipping package for the spreaders contained therein (see FIG. 3).

Further, it is important to the invention that the topmost portion 38 of the carton 26 fit within the inside surfaces of the walls of the bottom most portion 24. In this way when the filled carton arrives at the sales floor all that needs to be done is to sever whatever tape holds the two portions 24, 38 together, then lift the top portion out from the bottom portion, thus leaving the stacked array of spreaders therein visible and available for their separate removal by the potential purchaser. To aid the worker in lifting the top portion of 38 of the carton 26 from the bottom portion gripping holes 40 are provided in the sidewalls of the top portion 38.

It is also contemplated by the present invention to provide a stacked array of the type of spreader shown in my copending application, Ser. No. 08/357,917, the disclosure of which is incorporated herein by reference. In that application the collapsible spreaders shown are the same as in the present case except that the wheel base of the spreader is wider than the hopper, so that when the spreaders are stacked in the manner taught herein the wheels lie outside the hopper and are then contiguous with one another when two or more spreaders are stacked in the manner shown in FIG. 1. In this case the carton 26 will have a wider dimension to accommodate the wider spreader than that shown. Other than these minor differences, the same principles apply as in the present invention.

In FIG. 4 a generally triangular-shaped insert 42 of suitable stiffness such as cardboard is shown inserted in the crook or space between the back of the hopper 12 and the ends of the lower frame 20 to which the upper frame 18 is pivoted. The insert 42 may be provided with flap members 44 for straddling the legs of the lower frame for added support. As shown the top surface of the insert provides a flat surface for supporting the upright support frame 15 of the overlying spreader and thereby helps to maintain the superimposed spreader in a level position, that is, so that the hopper itself is seen to be in its operative and level position.

The foregoing relates to a preferred exemplary embodiment of the present invention, it being understood that other embodiments and variants thereof are possible within the scope of the invention, the latter being defined by the appended claims.

What is claimed and desired to be secured by Letters Patent of the United States is:

1. A two-part shipping and display carton in combination with a plurality of portable wheeled spreaders, each spreader having a hopper and a pair of wheels disposed below said hopper, the combination comprising a stacked array of said portable wheeled spreaders wherein said hopper of one spreader overlies the hopper of an underlying spreader, a bottom portion of said carton receiving said stacked array of spreaders, said bottom portion having four sidewalls and a bottomwall and being significantly lesser in height than the height of said stacked array of spreaders, whereby said stacked array of spreaders is visible as a display from said bottom portion of said carton, and a top portion of said carton having a similar cross-sectional shape as said bottom portion and a height that is slightly higher than the height of said stacked array of spreaders, said top portion of said carton being dimensioned to fit within said bottom portion so that the outside surface of the walls thereof contact the inside surface of said sidewalls of said bottom portion when said top portion is lowered into said bottom portion, whereby said two-part carton forms a shipping container for said stacked array of spreaders contained therein.

2. A two-part carton according to claim 1, wherein said bottom portion has one sidewall having a cut-out portion for allowing visibility of a portion of the bottommost spreader of said stacked array of spreaders.

3. A two-part carton according to claim 1, wherein a pair of opposing sidewalls of said bottom portion of said container have top edges which slope from back to front.

4. A two-part carton according to claim 1, wherein said top portion of said carton has a pair of gripping holes in a pair of sidewalls thereof.

5. A two-part carton according to claim 1, wherein said wheels of an overlying spreader are disposed within the hopper of an underlying spreader.

6. A two-part carton according to claim 1, wherein each said spreader further comprises a lower frame supporting said hopper, and an upper frame pivoted to said lower frame and being pivoted into a collapsed state so that said upper frame lies generally adjacent said lower frame.

7. A two-part carton according to claim 6, wherein a portion of said upper frame of an overlying spreader overlaps an articulated portion of said lower and upper frames of an underlying spreader.

8. A two-part carton according to claim 7, wherein there is further provided an insert member disposed between said hopper and said articulated portion of said lower and upper frames of said underlying spreader to thereby provide a flat surface upon which a support member for said one of said spreaders can rest.

* * * * *